US005535922A

United States Patent [19]

Maziarz

[11] Patent Number: 5,535,922

[45] Date of Patent: Jul. 16, 1996

[54] CAULKING GUN DISPENSING MODULE FOR MULTI-COMPONENT CARTRIDGE

[75] Inventor: Bernard J. Maziarz, Freehold, N.J.

[73] Assignee: TAH Industries, Inc., Robbinsville, N.J.

[21] Appl. No.: 346,521

[22] Filed: Nov. 29, 1994

[51] Int. Cl.[6] ..... B67D 5/52

[52] U.S. Cl. ..... 222/137; 222/327

[58] Field of Search ..... 222/137, 145.6, 222/183, 327, 386, 391

[56] References Cited

U.S. PATENT DOCUMENTS

| | | | |
|---|---|---|---|
| 3,162,337 | 12/1964 | Sabaka | 222/327 |
| 3,188,057 | 6/1965 | Trumbull | 222/229 |
| 3,311,265 | 3/1967 | Creighton, Jr. | 222/137 |
| 3,323,682 | 6/1967 | Creighton, Jr. | 222/94 |
| 4,364,388 | 12/1982 | Cech | 222/391 |
| 4,676,410 | 6/1987 | von Flue | 222/137 |
| 4,911,328 | 3/1990 | Keller | 222/137 |
| 4,974,756 | 12/1990 | Pearson et al. | 222/137 |
| 5,033,650 | 7/1991 | Colin et al. | 222/137 |
| 5,065,906 | 11/1991 | Maeder | 222/137 |
| 5,082,147 | 1/1992 | Jacobs | 222/137 |
| 5,104,005 | 4/1992 | Schneider, Jr. et al. | 222/137 |
| 5,184,757 | 2/1993 | Giannuzzi | 222/82 |
| 5,224,628 | 7/1993 | Keller | 222/327 |
| 5,310,091 | 5/1994 | Dunning et al. | 222/135 |

FOREIGN PATENT DOCUMENTS

| | | | |
|---|---|---|---|
| 2082686 | 3/1982 | United Kingdom | 222/137 |

*Primary Examiner*—Andres Kashnikow
*Assistant Examiner*—Philippe Derakshani
*Attorney, Agent, or Firm*—Davis, Bujold & Streck

[57] ABSTRACT

The invention provides a dispensing module for dispensing multi-part adhesive from a multi-component cartridge utilizing a standard caulking gun. The dispensing module comprises a piston actuator and a module housing which when assembled with a standard multi-component cartridge and inserted into a standard caulking gun allows the components from the multi-component cartridge to be dispensed.

11 Claims, 3 Drawing Sheets

CAULKING GUN DISPENSING MODULE FOR MULTI-COMPONENT CARTRIDGE

This invention relates to a dispensing module for dispensing multi-part adhesive from a standard multi-component cartridge utilizing a standard caulking gun. In particular, though not exclusively, the dispensing module comprises a piston actuator and a module housing. The standard multi-component cartridge is inserted into the module housing and the piston actuator is positioned behind the multi-component cartridge. Together the assembly is inserted into a standard caulking gun which provides the necessary action for dispensing the multi-part adhesive.

BACKGROUND OF THE INVENTION

Multi-component cartridges have become very popular packaging techniques for dispensing epoxy and a hardener, for example. However, their use has been limited because of the expense of special multi-rod dispensing guns. 3-M Corporation's "Scotchweld EPX Applicator" provides an example of these dispensing guns. There are no devices presently available which allow the components from a standard multi-component cartridge to be dispensed using a standard caulking gun.

OBJECT OF THE INVENTION

Accordingly, it is an objective of the present invention to provide a dispensing module for supporting and dispensing components from a standard multi-component cartridge utilizing a standard caulking gun.

Another object of the invention is to provide a module housing having internal ribs to center and hold the multi-component cartridge.

Another objective of the invention is to provide a piston actuator having attaching means to attach the piston actuator to the plunger of the caulking gun.

SUMMARY OF THE INVENTION

According to the invention there is provided a dispensing module comprising a module housing sized for accommodation by a standard caulking gun and defining an axis and having an alignment means for aligning a standard multi-component cartridge substantially coaxially with said axis of said module housing, said cartridge having at least two parallel component cylinders each having a piston; and, a piston actuator having at least two rods, each rod having a first end for engaging a said piston and a second end for contacting a plunger of a standard caulking gun for actuation thereby.

BRIEF INTRODUCTION TO THE DRAWINGS

The invention will now be described, by way of example, with reference to the accompanying drawings, in which.

DETAILED DESCRIPTION OF THE INVENTION

Figure 1:
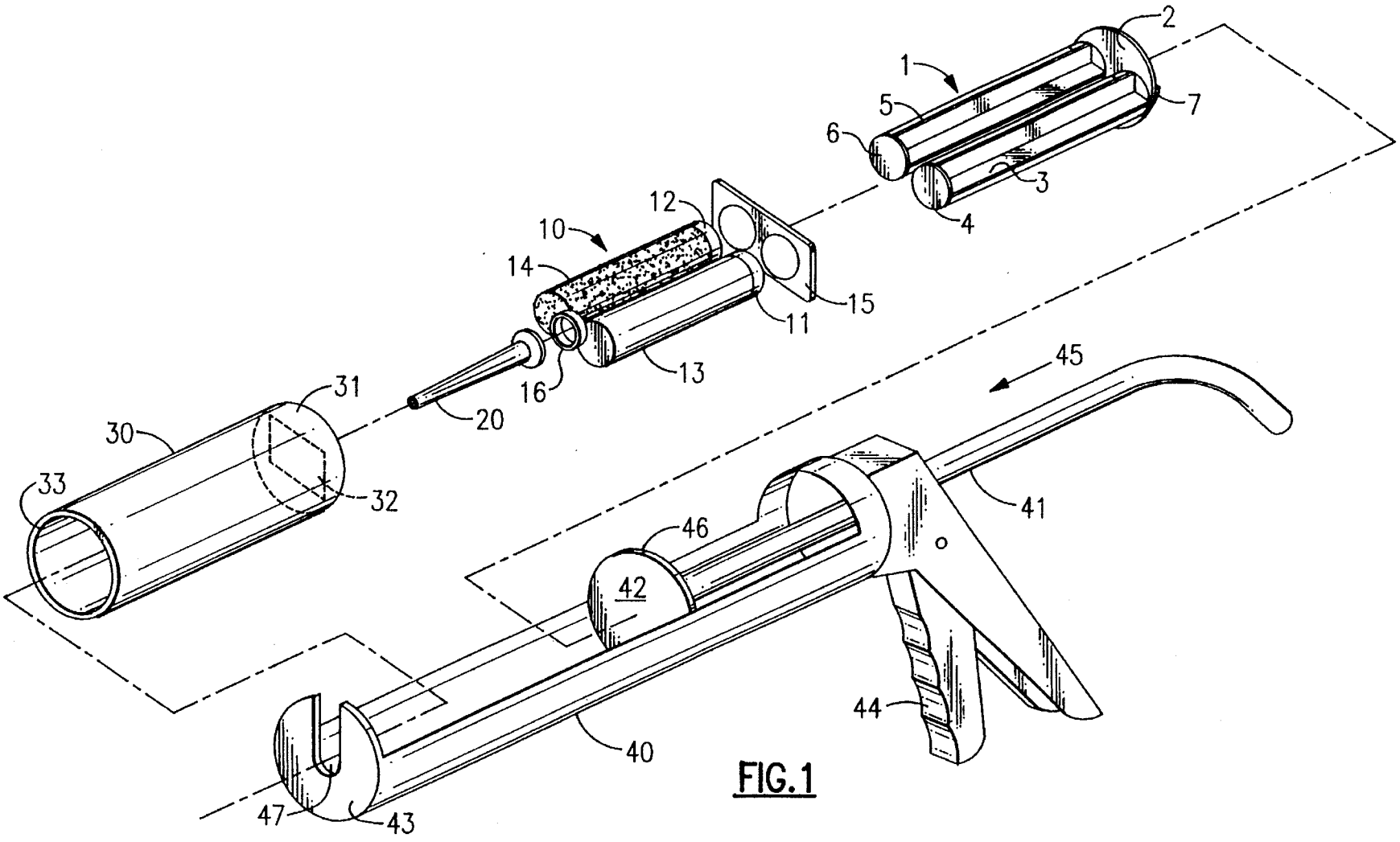
FIG. 1 is an exploded perspective view of the present invention showing the use of the dispensing module with a standard multi-component cartridge and a standard caulking gun.
Figure 2:
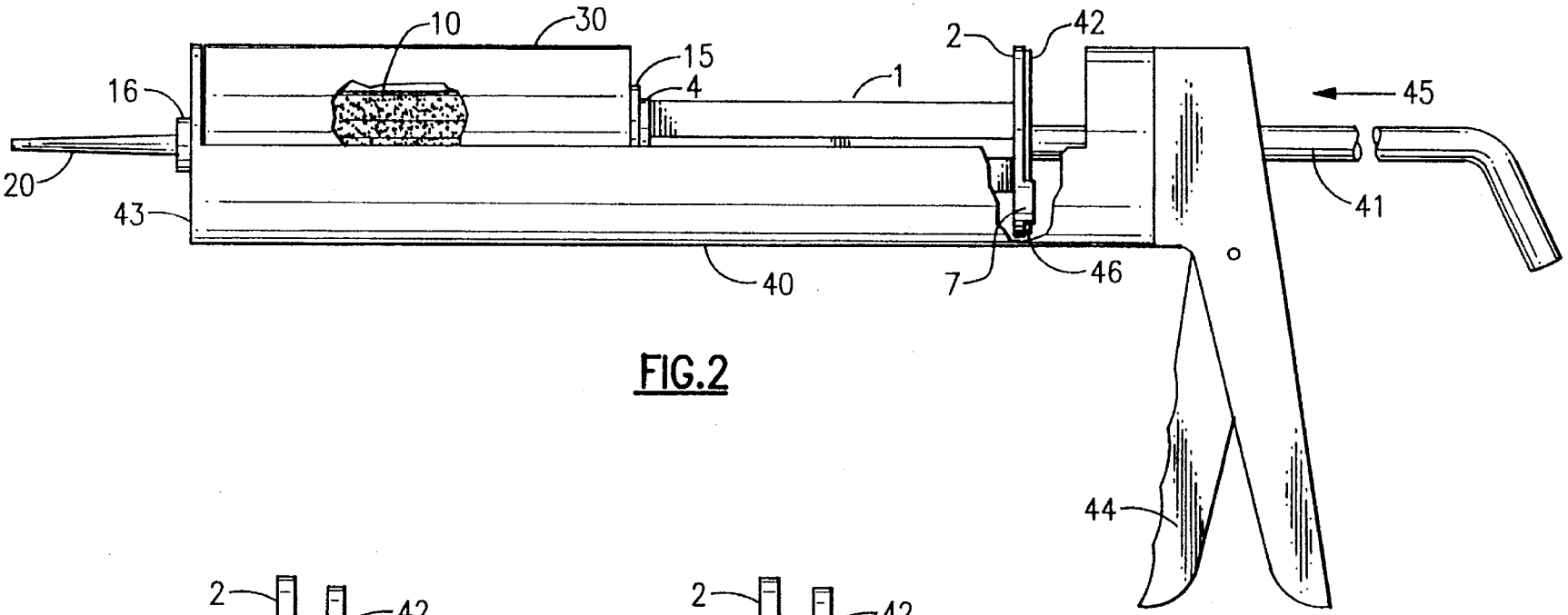
FIG. 2 is an elevation of the assembled dispensing module, multi-component cartridge and caulking gun.
Figure 7:
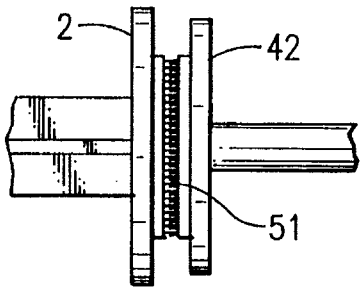
FIGS. 6 and 7 are fragmentary illustrations of alternatives to locating tabs.
Figure 6:
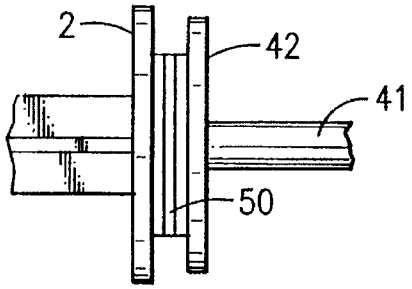

Turning first to FIGS. 1 and 2, there is shown a dispensing module comprising a piston actuator 1 and a module housing 30. Piston actuator 1 has plunger plate 2 and parallel rods 3 and 5, each having rod faces 4 and 6 respectively, for actuating pistons 11 and 12 of the multi-component cartridge 10. In operation, rods 3 and 5 are inserted into component cylinders 13 and 14 until rod faces 4 and 6 engage pistons 11 and 12. Multi-component cartridge 10 has an end plate 15 for preventing forward movement of multi-component cartridge 10 with respect to module housing 30 and an outlet 16 for dispensing components from component cylinders 13 and 14. A static mixing nozzle 20 is attached to outlet 16, by a bayonet or twist lock fitting (not shown), such that when the components flow from component cylinders 13 and 14, through outlet 16, and through the static mixing nozzle 20, a uniform mixture is provided. Multi-component cartridge 10 and nozzle 20 are then inserted into module housing 30 through shaped opening 32 in the stop plate 31. Front end 33 of module housing 30 is open to allow outlet 16 and static mixing nozzle 20 to protrude therefrom. The assembly (piston actuator 1, multi-component cartridge 10, static mixing nozzle 20 and module housing 30) is then inserted into a standard one-tenth gallon caulking gun 40. The caulking gun 40 has a plunger rod 41, plunger 42, front stop plate 43 and actuating handle 44.

As an operator actuates the caulking gun 40 by squeezing actuating handle 44, plunger rod 41 moves in direction shown by arrow 45. Plunger 42 is in contact with piston actuator 1, which, in turn, is engaged within component cylinders 13 and 14 of multi-component cartridge 10 located in module housing 30. Thus, the components in component cylinders 13 and 14 of multi-component cartridge 10 is dispensed through outlet 16 and static mixing nozzle 20.

The invention thus provides an inexpensive and easy to use dispensing module to be used in conjunction with a standard multi-component cartridge and standard caulking gun.

Figure 3:
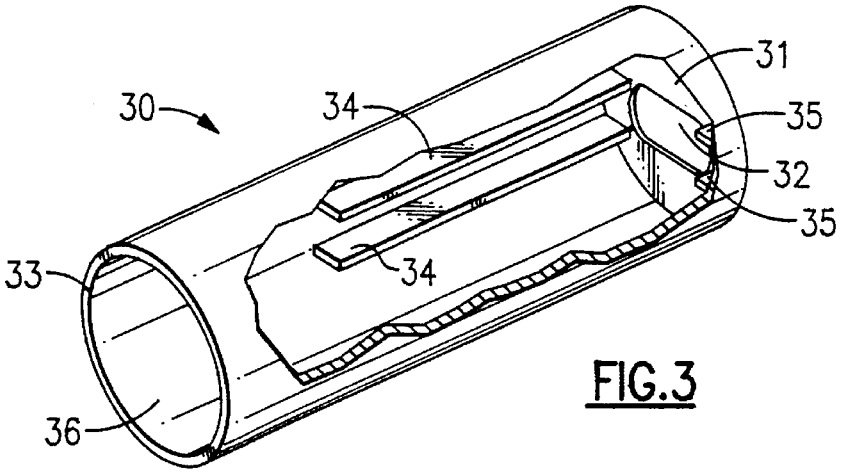
FIG. 3 is a cut away perspective view of the module housing showing the internal ribs to hold and center the multi-component cartridge.

Turning now to FIG. 3 there is shown module housing 30 in cutaway perspective view. Module housing 30 is provided with four internal ribs 34, 35 (internal ribs 35 are shown partially cutaway). Internal ribs 34, 35 extend from adjacent shaped opening 32 so as to provide an alignment and securing means to align and secure multi-component cartridge 10 within the module housing 30. Internal ribs 34, 35 engage component cylinders 14 and 13 respectively so as to keep multi-component cartridge 10 centered. Also, internal ribs 34, 35 provide an interference (friction) fit with component cylinders 14, 13. Once assembled, multi-component cartridge 10 is securely located within module housing 30 where outlet 16 and static mixing nozzle 20 protrudes through front opening 36. End plate 15 of multi-component cartridge 10 prevents multi-component cartridge 10 from being pushed clear through module housing 30 by engaging stop plate 31.

As will be apparent to one of ordinary skill in the art, internal ribs 34, 35 need not be employed provided, however, that the internal diameter of module housing 30 is sized to provide the required location of the component cylinders 13 and 14 of multi-component cartridge 10 in the interior of the module housing 30. In addition, internal ribs 34, 35 (or additional internal ribs) may be positioned perpendicular to internal ribs 34, 35 shown. Further, module housing need not be hollow as shown, but shaped opening 32 may extend through an otherwise solid modular housing to provide the necessary support and alignment of the multi-component cartridge 10 within the module housing 30. Alignment is desirable to facilitate single handed insertion of the dispenser module within the caulking gun 40. If nozzle opening 47 was relied on as the alignment means, positioning the dispensing module within the caulking gun 40 would be a cumbersome operation usually requiring two hands. Also, if there was no interference between module housing 30 and multi-component cartridge 10, multi-component cartridge 10 may inadvertently fall out of module housing 30 upon assembly into caulking gun 40.

Figure 4:
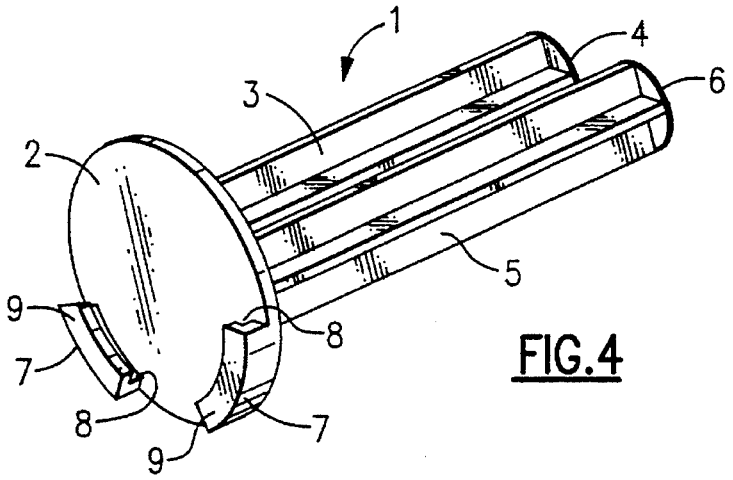
FIG. 4 is a perspective view of the rear end of the piston actuator showing the locating tabs.

Turning next to FIG. 4 there is shown piston actuator 1 from a rear perspective view. Rods 3, 5 are of cruciform cross-section having an effective outside diameter providing an interference fit within the component cylinders 13 and 14 of multi-component cartridge 10. The interference fit allows assembly of the dispenser module prior to inserting the dispenser module into the caulking gun 40 as with respect to the housing module 30 and multi-component cartridge 10. This allows for an easy one-hand insertion of the dispensing module into the caulking gun 40. Piston actuator 1 also has locating tabs 7 located on plunger plate 2. These locating tabs 7 have a channel 8 and rear wall 9 to engage edge 46 of plunger 42. The locating tabs 7 provide coaxial alignment of piston actuator 1 with the plunger rod 41 and plunger 42 to prevent buckling at the interface between piston actuator 1 and plunger 42. The locating tabs 7 also allow the withdrawal of the piston actuator 1 from the module housing 30. This is beneficial to decompress the multi-component cartridge 10 and prevent adhesive drooling.

Figure 5:
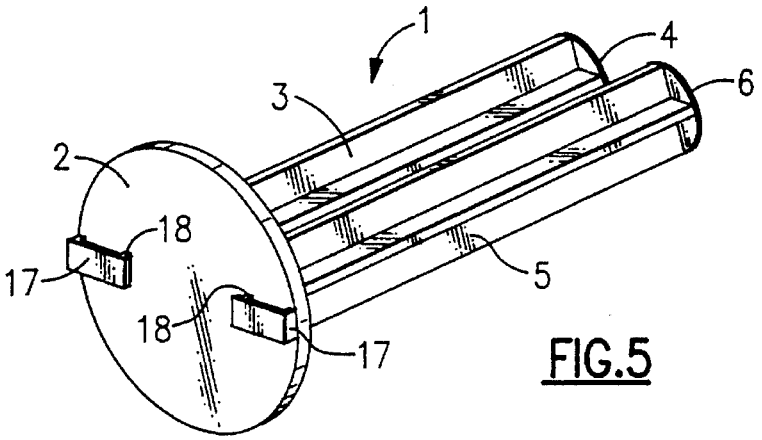
FIG. 5 is a perspective view of the rear end of the piston actuator showing an alternate embodiment of the locating tabs.

Alternatively, locating tabs 7 may be replaced with cantilever locating tabs 17 mounted along the sides of the plunger plate 2 as shown in FIG. 5. Here, the cantilever locating tabs 17 have a friction tab 18 on the inside surface. The friction tabs 18, together with the cantilever design of the cantilever locating tabs 17, positively engage the plunger 42 by biasing the plunger plate 2 toward the plunger 42.

Instead of tabs other techniques could be used to attach the piston actuator 1 to the plunger 42 of the caulking gun 40. For example, double sided adhesive tape 50 or a reusable hook and loop fastening device 51 such as VELCRO could be used to attach the piston actuator 1 to the plunger 42 of the caulking gun 40.

What is claimed is:

1. A dispensing module comprising:

a module housing sized for accommodation by a standard caulking gun, defining an axis, and having an alignment means for aligning a standard multi-component cartridge, having at least two parallel component cylinders each having a piston, substantially coaxially with said axis of said module housing; and a piston actuator having at least two rods, each rod having a first end for engaging a respective said piston and a second end for contacting a plunger of a standard caulking gun for actuation thereby;

wherein said module housing is hollow and has a stop plate at one end and a discharge opening at a second end, said stop plate has a shaped opening to accept said cartridge and said discharge opening is sufficiently large to permit, upon actuation, discharge of material from said cartridge through said discharge opening and out of a standard caulking gun.

2. The dispensing module according to claim 1 wherein said housing has a friction means for securing said cartridge within said housing.

3. The dispensing module according to claim 2 wherein said alignment means comprises internal ribs being located on an interior wall of said housing and extending substantially parallel to said axis of said housing.

4. The dispensing module according to claim 3 wherein said friction means comprises said internal ribs, said internal ribs being spaced within said housing to provide an interference between said internal ribs and said component cylinders of said multi-component cartridge.

5. The dispensing module according to claim 1 wherein said at least two rods are joined at said second end to a plunger plate.

6. The dispensing module according to claim 5 wherein said plunger plate has an attaching means for attaching said plunger plate to said plunger of said standard caulking gun.

7. The dispensing module according to claim 6 wherein said attaching means comprises locating tabs on said plunger plate shaped to engage an edge of said plunger of said standard caulking gun.

8. The dispensing module according to claim 6 wherein said attaching means comprises cantilevered locating tabs, each having a friction tab, on said plunger plate shaped to engage an edge of said plunger of said standard caulking gun.

9. The dispensing module according to claim 6 wherein said attaching means comprises double sided adhesive tape adhered to said plunger plate and said plunger of said standard caulking gun.

10. The dispensing module according to claim 6 wherein said attaching means comprises a hook and loop fastening device attached to said plunger plate and said plunger of said standard caulking gun.

11. The dispensing module according to claim 5 wherein said rods each have an effective outside diameter sufficient to provide an interference fit between said rods and said component cylinders of said multi-component cartridge.

* * * * *